United States Patent [19]

Sawanishi et al.

[11] 4,448,740

[45] May 15, 1984

[54] PROCESS FOR PRODUCING ACRYLIC FIBERS WITH EXCELLENT SURFACE SMOOTHNESS

[75] Inventors: Shigeru Sawanishi; Yozo Shiomi; Akira Yamane, all of Okayama, Japan

[73] Assignee: Japan Exlan Company Limited, Osaka, Japan

[21] Appl. No.: 456,292

[22] Filed: Jan. 6, 1983

[30] Foreign Application Priority Data

Jan. 26, 1982 [JP] Japan ..... 57-11089

[51] Int. Cl.[3] ..... D01F 6/18

[52] U.S. Cl. ..... 264/182; 264/210.8

[58] Field of Search ..... 264/182, 210.8

[56] References Cited

U.S. PATENT DOCUMENTS 3,621,087 11/1971 Shimamura et al. ..... 264/182
3,814,739 6/1974 Takeda ..... 264/182
3,885,013 5/1975 Sato ..... 264/182
3,975,486 8/1976 Sekiguchi et al. ..... 264/182
3,976,737 8/1976 Sekiguchi et al. ..... 264/182

FOREIGN PATENT DOCUMENTS 46-36490 10/1971 Japan ..... 264/182

*Primary Examiner*—Jay H. Woo
*Attorney, Agent, or Firm*—Wenderoth, Lind & Ponack

[57] ABSTRACT

The present invention provides a process for producing acrylic fibers having excellent surface smoothness and a color development ratio not less than 105%, without generating numerous wrinkles peculiar to wet spinning. The process comprises wet-spinning an acrylonitrile polymer spinning solution of from 50° to 70° C. having a viscosity of from 40 to 200 poises at 30° C., (a) with a spinning draft of from 0.05 to 0.2 in the case wherein the spinnerette orifice capillary length is 0.5 mm or less, and (b) with a spinning draft of from 0.13 to 2.0 in the case where the spinnerette orifice capillary length exceeds 0.5 mm; coagulating and water-washing the resulting fibers substantially without stretching; and thereafter wet-heat-stretching the fibers not less than 4 times in length at a temperature not lower than 80° C.

5 Claims, No Drawings

PROCESS FOR PRODUCING ACRYLIC FIBERS WITH EXCELLENT SURFACE SMOOTHNESS

The present invention relates to a process for producing acrylic fibers which have excellent surface smoothness, and more particularly it relates to a process for producing acrylic fibers having excellent surface smoothness and a hand-feel like animal hair, by spinning a spinning solution of a specific polymer of acrylonitrile (hereinafter abbreviated as AN).

Methods of producing acrylic fibers are roughly classified into wet-spinning method and dry-spinning method. The surface of the fibers produced by the latter method is generally excellent in surface smoothness so that the fibers have a hand-feel of softness and slipperiness like animal hair, while when a wet-spinning method is employed the hand-feel has not always been satisfactory enough because of numerous wrinkles generated on the fiber surface. Accordingly, if smooth fibers having no wrinkles on the surface could be produced by a wet-spinning method without new equipment investment for dry-spinning, it would be of great industrial importance.

In the light of such circumstances, we studied intensively on the mechanism of the generation of wrinkles on the fiber surface in the wet-spinning method. As a result, we have found that the stretching of fibers upon coagulation or the stretching of coagulated gel fibers at a temperature below the second order transition point is greatly involved in the generation of wrinkles, and that when such stretching of coagulated fibers is descreased and the fibers are subjected to no substantial stretching at a temperature below the second order transition point, it is possible to produce acrylic fibers having an animal hair-like hand-feel and excellent surface smoothness, softness, slipperiness, luster, color development, etc. This discovery led us to the present invention.

Therefore an object of the present invention is to provide, by a wet-spinning method, a process for producing acrylic fibers having excellent surface smoothness and a hand-feel like animal hair.

Another object of the present invention is to provide a process for producing acrylic fibers having much improved slipperiness by treatment with a softening agent, and excellent transparency, luster and color development of dyed articles.

Other objects of the present invention will become apparent from the following concrete explanation of the invention.

Such objects of the present invention are attained by wet-spinning an AN polymer spinning solution of from 50° to 70° C. having a viscosity of from 40 to 200 poises at 30° C., (a) with a spinning draft of 0.05 to 0.2 when the capillary length of the spinning orifices is 0.5 mm or less, and (b) with a spinning draft of 0.13 to 2.0 when the capillary length exceeds 0.5 mm; coagulating and water-washing the resulting fibers substantially without stretching; and thereafter wet-heat-stretching the fibers not less than 4 times in length at a temperature not lower than 80° C. By employing such a process, it has become possible to obtain acrylic fibers excellent in surface smoothness and having a color development ratio not less than 105%, without generating on the fiber surface numerous wrinkles peculiar to the case of employing a wet-spinning method.

The present invention will be detailed in the following: First, as regards the AN polymer spinning solution of the present invention, it is necessary to employ one having a viscosity of from 40 to 200 poises at 30° C. Only by employing a spinning solution having a viscosity in this range is it possible to provide fibers which are excellent in transparency and color development, without causing problems of spinnerette pressure, etc. Moreover, as regards the temperature of the spinning solution, it is necessary to employ a temperature within the range of from 50° to 70° C. In the case where the temperature is below the lower limit of this range, it is impossible to avoid the stretching of coagulated fibers due to Barus effect (swelling of filaments immediately after extrusion), making it impossible to suppress the formation of wrinkles on the fiber surface. Also, in the case where the temperature of the spinning solution exceeds the upper limit, voids will be formed in the fiber structure upon coagulation, so that it is impossible to provide fibers excellent in transparency and color development.

The AN polymers used in the present invention are polymers containing more than 50 weight %, preferably not less than 80 weight %, of AN. Among the monomers copolymerizable with AN, there may be mentioned vinyl acetate, acrylamide, acrylic acid and its esters, methacrylic acid and its esters, vinyl chloride, vinylidene chloride, vinyl bromide, sodium methallyl sulfonate, sodium vinylbenzene sulfonate, etc. Among the solvents for these polymers used upon spinning, there may be mentioned organic solvents such as dimethylformamide, dimethylacetamide, dimethyl sulfoxide, etc. and inorganic solvents such as aqueous solutions of nitric acid, sodium thiocyanate, zinc chloride, etc.

Next, concerning the spinning conditions, it is especially important to settle the draft conditions upon spinning in relation to the capillary length of the spinnerette orifices. It is necessary to employ (a) a draft condition upon spinning within the range of from 0.05 to 0.2, preferably from 0.06 to 0.15, when the capillary length of the spinnerette orifices is 0.5 mm or less, and (b) a draft condition upon spinning within the range of from 0.13 to 2.0, preferably from 0.15 to 1.0, when the capillary length exceeds 0.5 mm. Only by employing such conditions is it possible to suppress the formation of a surface structure having many wrinkles along the fiber axis generated by the stretching of coagulated fibers as a result of the above-mentioned swelling effect and the pulling of the extruded fibers. For controlling of the spinning draft in the above-mentioned range, this can be done by regulating the roller speed, quantity of extrusion of the spinning solution, diameter of spinnerette orifices, etc. Furthermore, it is preferable to diminish the quantity of extrusion under a constant draft condition to suppress the stretching of coagulated fibers due to the Barus effect, and therefore it is desirable to suppress the take-up roller speed to below 10 m/min. The retardation of the coagulating speed is desirable for the attainment of the objects of the present invention, and from this viewpoint, it is desirable to employ inorganic solvents, especially an aqueous solution of sodium thiocyanate, as the spinning solvent.

In the above-mentioned case (a), even if a spinnerette having orifices of a non-circular cross section is used, there is a tendency of forming fibers with a final circular cross section by the Barus effect. Therefore, in order to obtain fibers with non-circular cross section, it is recommended to employ the above-mentioned (b) condition, whereby it is possible to obtain surface-smooth fibers with excellent luster and glitter.

In the course of producing acrylic fibers, the fibers are usually subjected to cold-stretching in the water-washing step. By such cold-stretching, wrinkles are formed on the fiber surface. Therefore, it is necessary to conduct water-washing and solvent removal without carrying out stretching, for the attainment of the present invention.

Also, it is necessary to wet-heat-stretch the unstretched gel fibers thus spun, coagulated and water-washed not less than four times in length, preferably from 8 to 16 times, at a temperature not lower than 80° C.

Among the atmospheres in which the fibers are subjected to wet-heat-stretching, there may be mentioned hot water at a temperature not lower than 80° C., saturated steam, superheated steam, a mixture of steam and air, etc., but among these the use of hot water is preferable from an industrial point of view.

In the case where the wet-heat-stretching temperature is below the lower limit of the above-mentioned range, the stretchability will become poor and moreover the generation of wrinkles on the fiber surface cannot be suppressed. Also, in the case where a spinning solution having a viscosity within the specified range is emmployed but the stretching ratio is less than the lower limit of the above-mentioned range, it is impossible to provide fibers having physical properties satisfactory enough for practical use, and also such a stretching ratio is undesirable from a viewpoint of productivity.

The fibers thus produced may be suitably subjected to various treating steps including wet-heat relaxing treatment, re-stretching in a wet-heat or dry-heat atmosphere, crimping treatment, oiling treatment, drying, etc.

By employing the integral combination of the elements composing the process recommended in the present invention, it has become possible to produce acrylic fibers, by a wet-spinning method, which have a color development ratio of not less than 105%, preferably not less than 110%, and which are excellent in surface smoothness. In this connection, the color development ratio (K/S ratio) is a value measured as follows:

After causing the fibers for measurement to completely absorb 0.5% o.w.f. (based on the dry weight of the fibers) Aizen Catiron Blue K-2GLH (a cationic dye produced by Hodogaya Chemical Co., Ltd), the fibers are dried at 60° C. for 60 minutes. The reflexive color depth ($K_1/S_1$ value) of the dyed product after drying is measured by a Hunter reflexive light meter (Color Machine CM-20 produced by Color Machine Co., Ltd.) and the K/S ratio is calculated by the following formula:

$$K/S \text{ ratio} = \frac{(K_1 - S_1)}{(K_2 - S_2)} \times 100\ (\%)$$

wherein the denominator ($K_2-S_2$) shows the reflexive color depth obtained by the above-mentioned procedure, of a dyed product of usual acrylic fibers (Exlan® for example). The larger the K/S ratio, the better is the color development of the final fibers.

It is an effect of the present invention to be specially mentioned that acrylic fibers excellent in surface smoothness and color development can be produced without generating numerous wrinkles peculiar to a wet-spinning method on the fiber surface, without requiring any special installation and using a conventional wet-spinning installation.

It is also a remarkable effect of the present invention that it has become possible to produce acrylic fibers having much improved slipperiness by treatment with a softening agent, and having excellent transparency and luster. Such fibers having a hand-feel like animal hair are extremely useful as a material for blending with animal hair.

The present invention will be explained in further detail by way of Examples, but it is to be understood that the invention is not limited by these Examples. All percentages are by weight.

EXAMPLE 1

An AN copolymer (limiting viscosity number in dimethylformamide at 30° C.: 1.10) consisting of 90% AN, 9.8% methyl acrylate and 0.2% sodium methallyl sulfonate was dissolved in an aqueous sodium thiocyanate solution of a 50% concentration to prepare a spinning solution having a polymer concentration of 12.0% and a viscosity at 30° C. of 60 poises. The spinning solution maintained at 65° C. was extruded through a metallic spinnerette (50 orifices; orifice diameter: 0.04 mm, capillary length: 0.07 mm) into a 18% aqueous solution of sodium thiocyanate at −3° C., and the resulting filaments were taken up at a roller speed of 3 m/min and a spinning draft of 0.068. The gel filaments in the coagulating bath could be spun without slackening or any unusual problems. Subsequently, the filaments were washed with water under an untensioned state to remove the solvent, stretched 12.0 times in length in boiling water, dried in an atmosphere such that the dry bulb temperature/wet bulb temperature was 120° C./60° C., and subjected to relaxing heat treatment in saturated steam at 130° C., to produce Fiber A of 3 deniers.

Three kinds of Fibers B, C and D were produced in the same way as above except that the spinnerette orifice diameter, roller take-up speed and spinning draft were changed as described in Table 1. Fiber E was produced in the same way as above except that the stretching ratio was changed to 3.8 times and the spinnerette orifice diameter, roller take-up speed and spinning draft were changed as described in Table 1. Fiber F was produced according to the above-mentioned procedure except that the filaments were stretched 1.5 times (cold-stretching) in the step of water-washing and solvent removal and stretched 8.0 times in boiling water. Two kinds of Fibers G and H were produced according to the above procedure except that the same spinning solutions, but maintained at 40° C. and 75° C., were used respectively. Fiber I was produced in the same way as above except that a spinning solution (polymer concentration: 10%) having a viscosity of 30 poises at 30° C. was used.

Nine kinds of fibers thus obtained were measured for strength, elongation, transparency and K/S ratio, and the results of measurement are also given in Table 1. As the standard for obtaining color development ratio, Exlan® K8 fibers (3 d; circular cross-section) were employed.

TABLE 1

| | Fibers tested | | Fibers of the invention A | B | C | Fibers for comparison D | E | F | G | H | I |
|---|---|---|---|---|---|---|---|---|---|---|---|
| Spinning conditions | Spinning solution | Viscosity at 30° C. (poises) | 60 | 60 | 60 | 60 | 60 | 60 | 60 | 60 | 30 |
| | | Temperature (°C.) | 65 | 65 | 65 | 65 | 65 | 65 | 40 | 75 | 65 |
| | Spinnerette orifice diameter (mm) | | 0.04 | 0.05 | 0.06 | 0.075 | 0.033 | 0.04 | 0.04 | 0.04 | 0.04 |
| | Roller take-up speed (m/min) | | 3.0 | 3.0 | 2.7 | 8.3 | 2.6 | 3.0 | 3.0 | 3.0 | 3.0 |
| | Spinning draft | | 0.068 | 0.11 | 0.14 | 0.24 | 0.14 | 0.068 | 0.068 | 0.068 | 0.056 |
| | Cold-stretch ratio (times) | | 1.0 | 1.0 | 1.0 | 2.0 | 1.0 | 1.5 | 1.0 | 1.0 | 1.0 |
| | Wet-heat stretch ratio (times) | | 12.0 | 12.0 | 12.0 | 12.0 | 3.8 | 8.0 | 12.0 | 12.0 | 12.0 |
| Fiber characteristics | Denier (d) | | 3.0 | 3.0 | 3.0 | 3.0 | 3.0 | 3.0 | 3.1 | 3.0 | 3.0 |
| | Dry strength (g/d) | | 3.5 | 3.5 | 3.6 | 3.4 | 1.8 | 3.6 | 3.4 | 3.3 | 2.8 |
| | Dry elongation (%) | | 44 | 41 | 45 | 46 | 71 | 43 | 42 | 46 | 50 |
| | Transparency (%) | | 78 | 81 | 80 | 77 | 85 | 79 | 81 | 60 | 65 |
| | K/S ratio | | 120 | 120 | 118 | 100 | 123 | 103 | 108 | 104 | 106 |

(Note)
Transparency (%): 0.105 g of sample fibers cut in 2 mm lengths are dispersed in tricresyl phosphate, of which the refractive index at 30° C. has been adjusted to 1.504 with ethyl alcohol and the transmittance of light (wave length 420 mμ) through a 5 cm cell containing the dispersion is measured. This value is indicated as transparency.

From the results in Table 1, it is seen that the fibers of the present invention (Fibers A, B and C) have no problem in strength and elongation, and have an excellent transparency and color development ratio. As opposed thereto, in Fiber D, of which the spinning draft condition was outside the range of the present invention, in Fiber F subjected to cold stretching and in Fiber G, of which the temperature of the spinning solution was outside the lower limit of the present invention, numerous wrinkles were generated on the fiber surface and only fibers of poor color development were obtained. In Fiber E, of which the wet-heat stretching ratio was outside the present invention, there is a problem in strength-elongation characteristics in practical use. In Fiber H, of which the spinning solution temperature exceeded the upper limit of the present invention, and in Fiber I, of which the spinning solution viscosity was outside the present invention, only fibers of poor transparency and color development were obtained.

EXAMPLE 2

Fiber J was produced according to the procedure of Example 1 except that a non-circular spinnerette made of plastic material (largest width of the spinnerette orifice/narrowest width of the central constricted part=2.0; longer diameter/narrowest width=8.0; area: 0.0413 mm$^2$; capillary length: 3 mm) and the conditions described in Table 2 were employed. For comparison, Fiber K was produced according to the above-mentioned procedure except that a spinnerette having a capillary length of 0.3 mm and the conditions described in Table 2 were used.

The results of evaluation of the two kinds of fibers thus obtained are shown in Table 2. As the standard of color development ratio, Exlan® F 756 fibers (15 d; cross-section: cocoon shape) were used.

TABLE 2

| Fibers | J | K |
|---|---|---|
| Spinnerette capillary length (mm) | 3.0 | 0.3 |
| Roller take-up speed (m/min) | 3.7 | 11.1 |
| Spinning draft | 0.4 | 0.5 |
| Cold stretch ratio (times) | 1.0 | 2.0 |
| Wet heat stretch ratio (times) | 10.8 | 5.4 |
| Denier (d) | 15 | 15 |
| Dry strength (g/d) | 3.2 | 3.4 |
| Dry elongation (%) | 41 | 39 |
| K/S ratio | 121 | 100 |

As apparent from Table 2, Fiber J of the present invention has excellent color development and glitter, whereas Fiber K, which does not satisfy the present invention, had wrinkles on the fiber surface and was unsatisfactory in color development.

What is claimed is:

1. A process for producing acrylic fibers having excellent surface smoothness and a color development ratio not less than 105%, which comprises:

wet-spinning an acrylonitrile polymer spinning solution having a temperature of from 50° to 70° C. and a viscosity of from 40 to 200 poises at 30° C. (a) with a spinning draft of from 0.06 to 0.15 in the case where the spinnerette orifice capillary length is 0.5 mm or less, or (b) with a spinning draft of from 0.15 to 1.0 in the case where the spinnerette orifice capillary length exceeds 0.5 mm, coagulating and water-washing the resulting fibers substantially without stretching, and wet-heat stretching the fibers not less than 8 times in length at a temperature not lower than 80° C.

2. The process as claimed in claim 1 wherein the acrylonitrile polymer is a polymer containing combined therein more than 50 weight % acrylonitrile.

3. The process as claimed in claim 1 wherein the fibers are taken up with a roller take-up speed of less than 10 m/min.

4. The process as claimed in claim 1 wherein the fibers are wet-heat stretched in hot water.

5. The process as claimed in claim 1 wherein an inorganic solvent is used in forming the acrylonitrile polymer spinning solution.

* * * * *